US010487383B2

(12) United States Patent
Shikama et al.

(10) Patent No.: US 10,487,383 B2
(45) Date of Patent: Nov. 26, 2019

(54) METHOD FOR PRODUCING 7000-SERIES ALUMINUM ALLOY MEMBER EXCELLENT IN STRESS CORROSION CRACKING RESISTANCE

(71) Applicant: Kabushiki Kaisha Kobe Seiko Sho (Kobe Steel, Ltd.), Kobe-shi (JP)

(72) Inventors: Takahiro Shikama, Shimonoseki (JP); Shinji Yoshihara, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 16/101,718

(22) Filed: Aug. 13, 2018

(65) Prior Publication Data

US 2018/0347022 A1 Dec. 6, 2018

Related U.S. Application Data

(63) Continuation of application No. 14/979,670, filed on Dec. 28, 2015, now abandoned.

(30) Foreign Application Priority Data

Feb. 17, 2015 (JP) ..... 2015-029061

(51) Int. Cl.

| | |
|---|---|
| ***C22F 1/053*** | (2006.01) |
| ***C22C 21/10*** | (2006.01) |
| ***C21D 1/56*** | (2006.01) |

(52) U.S. Cl.

CPC ..... *C22F 1/053* (2013.01); *C21D 1/56* (2013.01); *C22C 21/10* (2013.01)

(58) Field of Classification Search

CPC ..... C22F 1/053

See application file for complete search history.

(56) References Cited

U.S. PATENT DOCUMENTS

| | | | |
|---|---|---|---|
| 4,420,345 | A | 12/1983 | Ito |
| 5,582,659 | A | 12/1996 | Hashimoto |
| 2014/0209223 | A1 | 7/2014 | Hashimoto et al. |
| 2016/0237540 | A1 | 8/2016 | Shikama |

FOREIGN PATENT DOCUMENTS

| | | |
|---|---|---|
| CN | 103966491 A | 8/2014 |
| JP | 2014-145119 | 8/2014 |

*Primary Examiner* — Scott R Kastler

(74) *Attorney, Agent, or Firm* — Oblon, McClelland, Maier & Neustadt, L.L.P.

(57) ABSTRACT

The stress corrosion cracking resistance of an aluminum alloy member consisting of 7000-series aluminum alloy extruded shape is improved. At least one region of a quenched aluminum alloy extruded shape is subjected to a restoring treatment of heating at a temperature-raising rate of 0.4° C./second or more, holding at a temperature ranging 300 to 590° C. for a time longer than zero second and cooling at a cooling rate of 0.5° C./second or more. A plastic working is applied to the region within 72 hours. The region is subjected to a heat treatment of heating at a temperature-raising rate of 0.4° C./second or more, holding at a temperature ranging 300 to 590° C. for a time longer than zero second and not longer than 300 seconds and cooling at a cooling rate of 2000° C./minute or less. The whole of the aluminum alloy extruded shape is subjected to an artificial aging treatment.

2 Claims, 1 Drawing Sheet

METHOD FOR PRODUCING 7000-SERIES ALUMINUM ALLOY MEMBER EXCELLENT IN STRESS CORROSION CRACKING RESISTANCE

This application is a continuation application of U.S. Ser. No. 14/979,670, filed Dec. 28, 2015 now abandoned; and claims priority to Japanese Patent Application No. 2015-029061, filed Feb. 17, 2015, the entirety of which is hereby incorporated by reference.

BACKGROUND OF THE INVENTION

Field of the Invention

The present invention relates to a method for producing a 7000-series aluminum alloy member, in which a plastic working such as crushing is applied to at least one region of a high-strength 7000-series aluminum alloy extruded shape, the region being along a longitudinal direction of the extruded shape, thereby rendering the extruded shape the member. The invention relates particularly to a method for producing a 7000-series aluminum alloy member excellent in stress corrosion cracking resistance.

Description of Related Art

JP 2014-145119 A listed below describes a method for producing a 7000-series aluminum alloy member, in which crushing is applied to at least one region of a 7000-series aluminum alloy extruded shape produced by press quenching, the region being along a longitudinal direction of the extruded shape, thereby rendering the extruded shape the member. According to this producing method, the region is subjected to a predetermined restoring treatment before the crushing; the crushing is then applied to the resultant workpiece within 72 hours of the end of the restoring treatment; and subsequently the whole of the resultant member is subjected to an aging treatment. The restoring treatment is conducted under conditions of heating the region at a temperature-raising rate of 0.4° C./second or more, holding the heated region in a temperature range of 200 to 550° C. for a time longer than zero second, and next cooling the region at a cooling rate of 0.5° C./second or more.

According to JP 2014-145119 A, before the crushing, the 7000-series aluminum alloy extruded shape is subjected to the restoring treatment, whereby an intermetallic compound precipitated by natural aging after the press quenching undergoes solid solution again so that the aluminum alloy extruded shape is softened to be improved in shapability (crushability). As a result, when the crushing is applied to the 7000-series aluminum alloy extruded shape after the restoring treatment, a bent web of the extruded shape can be prevented from being cracked at the outside of the bent web. Simultaneously, residual tensile stress generated in the web can be decreased, so that the resultant 7000-series aluminum alloy member can be improved in stress corrosion cracking resistance.

According to JP 2014-145119 A, before the crushing, the 7000-series aluminum alloy extruded shape is subjected to the predetermined restoring treatment, whereby the residual tensile stress generated by the crushing can be decreased so that the 7000-series aluminum alloy member can be improved in stress corrosion cracking resistance. However, in the 7000-series aluminum alloy member subjected to the crushing, the residual tensile stress generated by the crushing remains without being released. For this reason, in the method of JP 2014-145119 A, there remains a room for improving the stress corrosion cracking resistance.

SUMMARY OF THE INVENTION

Thus, an object of the present invention is to make a further improvement in the following when a plastic working such as crushing is applied to a 7000-series aluminum alloy extruded shape, thereby rendering the extruded shape a member: the stress corrosion cracking resistance of the resultant 7000-series aluminum alloy member.

Accordingly, the present invention is a method for producing an aluminum alloy member consisting of a 7000-series aluminum alloy extruded shape excellent in stress corrosion cracking resistance, comprising:

quenching the aluminum alloy extruded shape;

subjecting the quenched aluminum alloy extruded shape to natural aging for 12 hours or longer;

subjecting at least one region of the aluminum alloy extruded shape subjected to the natural aging to a restoring treatment of heating the region at a temperature-raising rate of 0.4° C./second or more, holding the region in a temperature range of 300 to 590° C. for a time longer than zero second and cooling the region at a cooling rate of 0.5° C./second or more;

applying a plastic working to the region within 72 hours of the end of the restoring treatment;

subjecting the region to a heat treatment of heating the region at a temperature-raising rate of 0.4° C./second or more, holding the region in a temperature range of 300 to 590° C. for a time longer than zero second and not longer than 300 seconds and cooling the region at a cooling rate of 2000° C./minute or less; and subjecting the whole of the aluminum alloy extruded shape subjected to the heat treatment to an artificial aging treatment.

After the aluminum alloy extruded shape is subjected to quenching treatment instead of the restoring treatment, a plastic working may be applied to the region within a time shorter than 12 hours of the end of the quenching.

In the producing method, examples of the plastic working widely include, besides the crushing, bending, tube expansion (for example, tube expansion by electromagnetic forming), punching, and any other plastic working in which residual tensile stress may be generated in a used material.

When a plastic working is applied to a 7000-series aluminum alloy extruded shape to render the extruded shape a member, the present invention makes it possible to provide, as the member, a 7000-series aluminum alloy member which is decreased in residual tensile stress generated by the plastic working to be further improved in stress corrosion cracking resistance.

DESCRIPTION OF THE PREFERRED EMBODIMENTS

Figure 1:
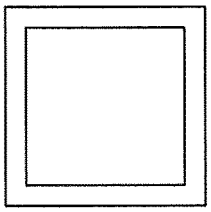
FIG. 1 is a schematic sectional view of any one of 7000-series aluminum alloy extruded shapes produced in Examples.

Hereinafter, a description will be specifically made about a 7000-series aluminum alloy member related to the present invention, and the method according to the invention for producing the member.

Composition of Aluminum Alloy:

The composition of a 7000-series aluminum alloy related to the present invention will be firstly described. This composition is identical with that of the 7000-series aluminum alloy described in JP 2014-145119 A.

Zn: 3.0 to 8.0% by mass; and

Mg: 0.4 to 2.5% by mass:

Zn and Mg are elements to produce $MgZn_2$, which is an intermetallic compound, to improve the 7000-series aluminum alloy in strength. If the Zn content by percentage is less than 3.0% by mass or the Mg content by percentage is less than 0.4% by mass, the resultant alloy member cannot gain a yield strength of 200 MPa or more, which is necessary for a practical member. In the meantime, if the Zn content is more than 8.0% by mass or the Mg content is more than 2.5% by mass, the extruded shape cannot be prevented, when subjected to a plastic working, from being cracked, and simultaneously residual tensile stress generated by the plastic working becomes large. Thus, the plastically-worked workpiece cannot be improved in stress corrosion cracking resistance even by being subjected to a subsequent heat treatment. From the viewpoint of an improvement of the resultant member in strength and lightness, the Zn content and the Mg content are each preferably in a higher alloy side of the range, and are preferably, for example, from 5.0 to 8.0% by mass and from 1.0 to 2.5% by mass, respectively. The total of these contents is preferably from 6.0 to 10.5% by mass.

Cu: 0.05 to 2.0% by mass:

Cu is an element for improving the 7000-series aluminum alloy in strength. If the Cu content by percentage is less than 0.05% by mass, the strength-improving effect is not sufficiently produced. In the meantime, if the Cu content is more than 2.0% by mass, the alloy is lowered in extrudability. The Cu content is preferably from 0.5 to 1.5% by mass.

Ti: 0.005 to 0.2% by mass:

Ti has an effect of making crystal grains of the 7000-series aluminum alloy fine when the alloy is cast, thereby improving the extruded shape in shapability. Ti is added to the alloy in a proportion of 0.005% or more by mass. In the meantime, if the Ti content by percentage is more than 0.2% by mass, the effect is saturated and further coarse particles of an intermetallic compound are crystalized out so that the shapability is conversely lowered.

Mn: 0.01 to 0.3% by mass;

Cr: 0.01 to 0.3% by mass; and

Zr: 0.01 to 0.3% by mass:

Mn, Cr and Zr each have an effect of restraining the 7000-series aluminum alloy extruded shape from being recrystallized to render the crystal microstructure a finely re-crystalline or fibrous microstructure, thereby improving the resultant alloy member in stress corrosion cracking resistance. One or more of these elements are (each) added to the alloy in a proportion within the above-mentioned corresponding range.

Inevitable Impurities:

Inevitable impurities of the 7000-series aluminum alloy are mainly Fe and Si. The content by mass of Fe is restricted to 0.35% or less by mass, and that of Si is restricted to 0.3% or less by mass not to lower various properties of the 7000-series aluminum alloy.

Method for Producing Aluminum Alloy Member:

A 7000-series aluminum alloy extruded shape having the above-mentioned composition is press-quenched, or is reheated in, for example, an air furnace and then quenched. The extruded shape is then naturally aged (usually, the extruded shape is stored for a time from several days to several months, and then the natural aging advances). The entire region or a partial region of this extruded shape is subjected to a restoring treatment, the region being a region along a longitudinal direction of the extruded shape. The restoring treatment is conducted under conditions of heating the region at a temperature-raising rate of 0.4° C./second or more, holding the region in a temperature range of 300 to 590° C. for a time longer than zero second, and next cooling the region at a cooling rate of 0.5° C./second or more. The cooling in the quenching (the press quenching or the quenching after the re-heating) is desirably performed at a cooling rate of 0.5° C./second or more (in a fan wind cooling manner).

A plastic working is applied to the region within 72 hours of the end of the restoring treatment, thereby rendering the extruded shape a member. The region is further subjected to a predetermined heat treatment (referred to as a late heat treatment hereinafter). Thereafter, the whole of the member is subjected to an aging treatment. The late heat treatment is conducted under conditions of heating the region at a temperature-raising rate of 0.4° C./second or more, holding the region in a temperature range of 300 to 590° C. for a time longer than zero second and not longer than 300 seconds, and next cooling the region at a cooling rate of 2000° C./minute or less.

In the quenched extruded shape, an intermetallic compound is precipitated by the natural aging so that the extruded shape is hardened. However, as described in JP 2014-145119 A also, before the plastic working, this quenched extruded shape is subjected to the restoring treatment, whereby the intermetallic compound undergoes solid solution again so that the extruded shape is softened to be improved in shapability. This matter makes it possible that when the plastic working is applied to the region subjected to the restoring treatment, the region is prevented from being cracked, and simultaneously residual tensile stress generated in the region is decreased. A heating means for the restoring treatment may be, for example, a high frequency induction heating device or a niter furnace.

For reference, about any 7000-series aluminum alloy extruded shape, the natural aging thereof advances rapidly. Thus, after quenched, the extruded shape is hardened when about 12 hours elapse. Consequently, the shapability thereof is lowered. The above-mentioned restoring treatment is applied to the aluminum alloy extruded shape which has undergone the natural aging for 12 hours or longer after the quenching (which has undergone time-lapse for 12 hours or longer after the quenching).

If the temperature-raising rate is less than 0.4° C./second in the restoring treatment, the precipitation of the intermetallic compound is promoted in the temperature-raising process, so that the effects of the restoring treatment cannot be obtained.

If the holding temperature (actual body temperature) is lower than 300° C., the intermetallic compound precipitated by the natural aging does not undergo solid solution again so that the precipitation is conversely promoted. Thus, the effects of the restoring treatment are not obtained. In the meantime, if the holding temperature is higher than 590° C., burning may be unfavorably caused.

The holding time for the restoring treatment is made longer than zero second. In other words, after the extruded shape arrives at the holding temperature, it is allowable to hold the extruded shape at the same temperature for a predetermined time and then cool the extruded shape, or cool the extruded shape immediately. The upper limit of the holding time is not particularly limited. The temperature-holding is ended in a short time preferably within, for example, 60 seconds, more preferably within 10 seconds, even more preferably within 5 seconds from the viewpoint of the production efficiency of the alloy member. When a partial region of the extruded shape is subjected to the restoring treatment, it is preferred to make the holding time shorter to prevent a region adjacent to the partial region from being softened by a halfway heat-conduction to the adjacent region.

In the restoring treatment, according to such a mild cooling that the rate of the cooling from the holding temperature is less than 0.5° C./second, an intermetallic compound is again precipitated in the cooling process, so that the effects of this restoring treatment are decreased or lost. This cooling rate is preferably a cooling rate (for example, 150° C./minutes or more) equal to or larger than that based on fan wind cooling. The cooling is more preferably water cooling. About any conventional restoring treatment, the cooling rate in a cooling process in the treatment is not especially considered.

The reason why the plastic working is conducted within 72 hours of the end of the restoring treatment in the present invention is that the plastic working needs to be conducted before the extruded shape undergoes the precipitation of an intermetallic compound by natural aging so as to be again hardened.

The late heat treatment after the plastic working is conducted to release residual tensile stress generated by the plastic working to improve the resultant 7000-series aluminum alloy member in stress corrosion cracking resistance. A heating means for this late heat treatment may be, for example, a high frequency induction heating device or a niter furnace.

If the temperature-raising rate in the late heat treatment is less than 0.4° C./second, the production efficiency of the alloy member is lowered. When a partial region of the member is subjected to the late heat treatment, it is preferred that the temperature-raising rate is large to prevent a region adjacent to the partial region from being softened by a halfway heat-conduction to the adjacent region.

If the holding temperature (actual body temperature) in the late heat treatment is lower than 300° C., the residual tensile stress of the member is not sufficiently released so that the stress corrosion cracking resistance cannot be improved. In the meantime, if the holding temperature is higher than 590° C., burning may be unfavorably caused.

The holding time for the late heat treatment is made longer than zero second. In other words, after the member arrives at the holding temperature, it is allowable to hold the member at the same temperature for a predetermined time and then cool the member, or cool the member immediately. The holding time is rendered a short time preferably within 300 seconds, more preferably within 10 seconds, even more preferably within 5 seconds from the viewpoint of the production efficiency. When the above-mentioned partial region is subjected to the late heat treatment, it is preferred to make the holding time shorter to prevent the above-mentioned adjacent region from being softened by a halfway heat-conduction to the adjacent region.

If the cooling in the late heat treatment is such a rapid cooling that the rate of cooling from the holding temperature is more than 2000° C./minute, the solid solution quantity of the intermetallic compound increases (the precipitation thereof is not much caused in the cooling). This matter causes the following: the intermetallic compound is finely and continuously precipitated in crystal grain boundaries by a subsequent artificial aging treatment so that the precipitated compound is melted in a corrosive environment to lower the member in stress corrosion cracking resistance. The cooling from the holding temperature may be a mild cooling (at a rate of 10° C./minute), such as natural cooling; in order that the member after the aging treatment can gain a high strength, the rate of the cooling is preferably a cooling rate (for example, 150° C./minutes or more) equal to or larger than that based on fan window cooling.

Conditions for the artificial aging treatment are not particularly limited and may be generic conditions for an aging treatment to be conducted for any ordinary 7000-series aluminum alloy. Alternatively, the conditions may be higher-temperature and longer-time aging treatment (over-aging treatment) conditions than the generic aging treatment conditions. The effect of improving the stress corrosion cracking resistance by the late heat treatment after the plastic working can be gained whether the subsequent artificial aging treatment is a generic aging treatment or over-aging treatment.

The above has described the method according to the present invention for producing an aluminum alloy member. Instead of subjecting the naturally aged aluminum alloy extruded shape to the restoring treatment described therein, a plastic working may be applied to an aluminum alloy extruded shape subjected to quenching (press quenching, or quenching after re-heating) within a time shorter than 12 hours of the end of the quenching. When the plastic working is performed within a time shorter than 12 hours of the end of the quenching, the natural aging of the 7000-series aluminum alloy extruded shape does not advance. Thus, in the same manner as after the restoring treatment, the extruded shape is prevented from being cracked, and further the residual tensile stress generated by the plastic working is decreased to improve the resultant in stress corrosion cracking resistance.

EXAMPLES

A 7000-series aluminum alloy billet having a composition of each of (Comparative) Examples Nos. 1 to 22 shown in Table 1 was subjected to homogenizing treatment at 70° C. for 6 hours, and then extruded at an extruding temperature (billet temperature) of 470° C. and an extruding rate of 5 m/minute. After the extrusion, the extruded shape was subjected to press quenching, using fan wind cooling (cooling rate: about 200° C./minute). As illustrated in FIG. 1, the extruded shape had a cross section having a rectangular shape 45 mm in height and 45 mm in width. The thickness thereof was wholly 2 mm.

TABLE 1

| | | Composition (% by mass of each component) | | | | | | | | | |
|---|---|---|---|---|---|---|---|---|---|---|---|
| | | Fe | Si | Cu | Mn | Mg | Cr | Zn | Ti | Zr | Al |
| Examples | 1 | 0.17 | 0.07 | 0.20 | — | 1.50 | — | 6.02 | 0.03 | 0.15 | Remainder |
| | 2 | 0.16 | 0.06 | 0.06 | — | 1.49 | — | 5.98 | 0.02 | 0.14 | Remainder |
| | 3 | 0.15 | 0.06 | 1.01 | — | 1.47 | — | 6.14 | 0.03 | 0.15 | Remainder |

TABLE 1-continued

| | | Composition (% by mass of each component) | | | | | | | | | |
|---|---|---|---|---|---|---|---|---|---|---|---|
| | | Fe | Si | Cu | Mn | Mg | Cr | Zn | Ti | Zr | Al |
| | 4 | 0.17 | 0.07 | 1.90 | — | 1.47 | — | 6.02 | 0.02 | 0.15 | Remainder |
| | 5 | 0.17 | 0.06 | 0.21 | 0.03 | 1.41 | — | 5.98 | 0.02 | 0.14 | Remainder |
| | 6 | 0.15 | 0.07 | 0.19 | 0.19 | 1.46 | — | 6.15 | 0.03 | — | Remainder |
| | 7 | 0.18 | 0.07 | 0.17 | 0.28 | 1.46 | — | 6.24 | 0.02 | — | Remainder |
| | 8 | 0.17 | 0.07 | 0.21 | — | 0.50 | — | 5.99 | 0.03 | 0.16 | Remainder |
| | 9 | 0.16 | 0.06 | 0.19 | — | 1.40 | — | 6.23 | 0.02 | 0.14 | Remainder |
| | 10 | 0.18 | 0.06 | 0.17 | — | 2.30 | — | 5.87 | 0.03 | 0.13 | Remainder |
| | 11 | 0.16 | 0.07 | 0.21 | — | 1.50 | 0.03 | 6.02 | 0.02 | 0.15 | Remainder |
| | 12 | 0.17 | 0.06 | 0.19 | — | 1.49 | 0.12 | 5.97 | 0.03 | — | Remainder |
| | 13 | 0.18 | 0.06 | 0.17 | — | 1.47 | 0.26 | 6.14 | 0.02 | — | Remainder |
| | 14 | 0.17 | 0.07 | 0.18 | — | 1.47 | — | 3.50 | 0.02 | 0.15 | Remainder |
| | 15 | 0.16 | 0.06 | 0.17 | — | 1.41 | — | 6.41 | 0.02 | 0.16 | Remainder |
| | 16 | 0.16 | 0.07 | 0.19 | — | 1.46 | — | 7.80 | 0.02 | 0.14 | Remainder |
| Comparative | 17 | 0.17 | 0.06 | 0.17 | — | 1.46 | — | 6.02 | 0.01 | 0.13 | Remainder |
| Examples | 18 | 0.15 | 0.07 | 0.21 | — | 1.50 | — | 5.98 | 0.09 | 0.15 | Remainder |
| | 19 | 0.17 | 0.06 | 0.19 | — | 1.49 | — | 6.14 | 0.19 | 0.16 | Remainder |
| | 20 | 0.18 | 0.07 | 0.17 | — | 1.47 | — | 6.21 | 0.03 | 0.02 | Remainder |
| | 21 | 0.17 | 0.07 | 0.18 | — | 1.47 | — | 5.99 | 0.02 | 0.15 | Remainder |
| | 22 | 0.15 | 0.07 | 0.17 | — | 1.41 | — | 6.28 | 0.03 | 0.27 | Remainder |

Figure 2:
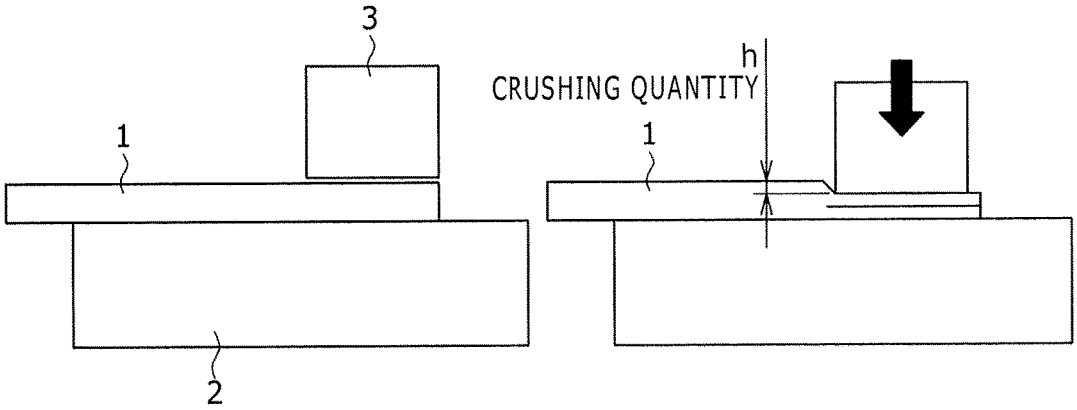
FIG. 2 is a side view illustrating a method for a plastic working (crushing) test in the Examples.

This extruded shape was cut into each length of 1000 mm to prepare test specimens. About each of the specimens of each of Examples Nos. 1 to 14, and Comparative Examples Nos. 17 to 22, after 96 hours from the end of the press quenching, a partial region of the test specimen along a longitudinal direction of the test specimen (the region being extended, by 200 mm, from one of the two ends in the longitudinal direction of the specimen) was subjected to a restoring treatment under conditions shown in Table 2. Thereafter, a press forming machine was used to apply a cold-crushing to the region. FIG. 2 illustrates a situation of the specimen and others before the crushing, and the same after the crushing. Reference number 1 represents the test specimen (extruded shape); 2, a table of the press forming machine; and 3, a tool for the crushing. About each of Examples Nos. 15 and 16, without conducting any restoring treatment, the same cold crushing was performed after 10 hours from the end of the press quenching. About each of (Comparative) Examples, the crushing quantity h through the crushing is shown in Table 2.

Subsequently, in each of (Comparative) Examples, the region (subjected to the crushing) was subjected to a late heat treatment under conditions shown in Table 2 (provided that only in Comparative Example No. 17, no late heat treatment was conducted). Thereafter, the resultant was subjected to an artificial aging treatment under conditions shown in Table 2.

Any one of the test specimens subjected to the artificial aging treatment was used to make an SCC (stress corrosion cracking) test based on a chromic acid method in accordance with a manner described below. Separately, any one of the test specimens was subjected to a tensile test in accordance with a manner described below. The results are shown in Table 2.

SCC Test:

An (aqueous) test solution containing 3.6% by mass of $CrO_3$, 3.0% by mass of $K_2Cr_2O_7$ and 0.3% by mass of NaCl was heated to 95 to 100° C., and then the test specimen was immersed into the solution for 16 hours. Thereafter, it was checked whether or not SCC was generated in the region subjected to the crushing. This SCC test was made under severer conditions about temperature and time than under those of the SCC test made in Examples in JP 2014-145119 A.

Tensile Test:

The extruded shape subjected to the press quenching in each of (Comparative) Examples was cut into a predetermined length to prepare a test sample. After 96 hours from the end of the press quenching, the test sample was subjected to a restoring treatment under conditions shown in Table 2 (provided that only in Examples Nos. 15 and 16, no restoring treatment was conducted). Subsequently, the test sample was subjected to a late heat treatment under conditions shown in Table 2 (provided that only in Comparative Example No. 17, no late heat treatment was conducted). Thereafter, the test sample was subjected to an artificial aging treatment under conditions shown in Table 2. From the test sample subjected to the artificial aging treatment, a JIS #5 test piece was collected to make a longitudinal direction thereof along the extruding direction. The tensile strength thereof was measured in accordance with a JIS-Z2241 tensile test method.

TABLE 2

| | | Restoring treatment | | | | | Heat treatment after crushing | | | | Artificial | | |
|---|---|---|---|---|---|---|---|---|---|---|---|---|---|
| | No. | Temperature-raising rate (° C./min.) | Heating temperature (° C.) | Holding time (sec.) | Cooling rate (° C./min) | Crushing Crushing quantity (mm) | Temperature-raising rate (° C./min) | Heating temperature (° C.) | Holding time (sec.) | Cooling rate (° C./min) | aging treatment (temperature (° C.) × time (hr.) | Tensile strength (MPa) | SCC |
| Examples | 1 | 30 | 450 | 5 | 12000 | 15 | 30 | 450 | 5 | 300 | 120 × 14 | 440 | Not generated |
| | 2 | | | | | | 600 | 450 | 5 | 300 | | 437 | Not generated |
| | 3 | | | | | | 900 | 450 | 5 | 300 | | 460 | Not generated |

TABLE 2-continued

| | | Restoring treatment | | | | | Heat treatment after crushing | | | | Artificial | | |
|---|---|---|---|---|---|---|---|---|---|---|---|---|---|
| | No. | Temperature-raising rate (° C./min.) | Heating temperature (° C.) | Holding time (sec.) | Cooling rate (° C./min) | Crushing Crushing quantity (mm) | Temperature-raising rate (° C./min) | Heating temperature (° C.) | Holding time (sec.) | Cooling rate (° C./min) | aging treatment (temperature (° C.) × time (hr.) | Tensile strength (MPa) | SCC |
| | 4 | 900 | | | | | 900 | 420 | 5 | 300 | | 481 | Not generated |
| | 5 | | | | | | 900 | 480 | 5 | 300 | | 439 | Not generated |
| | 6 | | | | | | 900 | 540 | 5 | 300 | | 441 | Not generated |
| | 7 | | | | | | 900 | 450 | 0 | 300 | | 443 | Not generated |
| | 8 | 300 | 380 | 30 | 9000 | 10 | 900 | 450 | 10 | 300 | | 391 | Not generated |
| | 9 | | | | | | 900 | 450 | 100 | 300 | | 482 | Not generated |
| | 10 | | | | | | 900 | 450 | 200 | 300 | | 531 | Not generated |
| | 11 | | | | | | 900 | 450 | 300 | 300 | | 472 | Not generated |
| | 12 | | | | | | 900 | 450 | 5 | 1000 | | 474 | Not generated |
| | 13 | | | | | | 900 | 450 | 5 | 800 | | 476 | Not generated |
| | 14 | | | | | | 900 | 450 | 5 | 600 | | 351 | Not generated |
| | 15 | | Not conducted | | | | 900 | 450 | 5 | 400 | | 476 | Not generated |
| | 16 | | Not conducted | | | | 900 | 450 | 5 | 200 | | 512 | Not generated |
| Comparative Examples | 17 | 600 | 410 | 10 | 10800 | 8 | | Not conducted | | | | 436 | Generated |
| | 18 | | | | | | 900 | 180* | 60 | 200 | | 401 | Generated |
| | 19 | | | | | | 900 | 280* | 30 | 180 | | 392 | Generated |
| | 20 | | | | | | 900 | 450 | 5 | 2400* | | 474 | Generated |
| | 21 | | | | | | 900 | 450 | 400* | 190 | | 191 | Not generated |
| | 22 | | | | | | 20* | 450 | 1 | 200 | | 184 | Not generated |

*a value out of the requirement-ranges of the invention

As illustrated in Table 2, in each of Examples Nos. 1 to 16 of the present invention, in which the late heat treatment was conducted under the conditions specified in the invention after the plastic working, no SCC was generated to give a high strength (200 MPa or more).

In the meantime, in Comparative Example 17 comparative against the present invention, in which no late heat treatment was conducted after the crushing, SCC was generated. It can be considered that this is because residual stress generated by the crushing was not released by the late heat treatment. The producing process for Comparative Example No. 17 simulated the method described in JP 2014-145119 A.

In each of Comparative Examples Nos. 18 and 19, in which the holding temperature in the late heat treatment was out of the requirements of the present invention, SCC was generated. It can be considered that the holding temperature in the late heat treatment was low to produce only a small effect of releasing the residual stress generated by the crushing so that the SCC was generated.

In Comparative Example No. 20, in which the cooling rate in the late heat treatment was out of the requirements of the present invention, SCC was generated. It can be considered that in this example, residual stress was more and less lowered by the late heat treatment, but the large cooling rate made the solid solution quantity of $MgZn_2$ large, so that after the artificial aging treatment the precipitates in the grain boundaries turned into a fine and continuous state, whereby the workpiece heightened in SCC sensitivity to generate the SCC.

In Comparative Example No. 21, in which the holding time in the late heat treatment was out of the requirements of the present invention, the temperature-raising rate in the late heat treatment was small so that the time until the specimen temperature arrived at the holding temperature became long. In Comparative Example No. 22, in which the temperature-raising rate in the late heat treatment was out of the requirements of the invention, the holding time at the holding temperature was long. In each of these examples, heat was conducted to a region near the region subjected to the late heat treatment so that this near-region turned into an annealed state, so that the strength was lowered (into less than 200 MPa).

What is claimed is:

1. A method for producing an aluminum alloy member consisting of a 7000-series aluminum alloy extruded shape excellent in stress corrosion cracking resistance, comprising:

quenching the aluminum alloy extruded shape;

subjecting the quenched aluminum alloy extruded shape to natural aging for 12 hours or longer;

subjecting at least one region of the aluminum alloy extruded shape subjected to the natural aging to a restoring treatment of heating the region at a temperature-raising rate of 0.4° C./second or more, holding the region in a temperature range of 300 to 590° C. for a time longer than zero second and cooling the region at a cooling rate of 0.5° C./second or more;

applying a plastic working to the region within 72 hours of the end of the restoring treatment;

subjecting the region to a heat treatment of heating the region at a temperature-raising rate of 0.4° C./second or more, holding the region in a temperature range of 300 to 590° C. for a time longer than zero second and not longer than 300 seconds and cooling the region at a cooling rate of 2000° C./minute or less; and subjecting the whole of the aluminum alloy extruded shape subjected to the heat treatment to an artificial aging treatment.

2. A method for producing an aluminum alloy member consisting of a 7000-series aluminum alloy extruded shape excellent in stress corrosion cracking resistance, comprising:

quenching the aluminum alloy extruded shape;

applying a plastic working to at least one region of the quenched aluminum alloy extruded shape within a time shorter than 12 hours of the end of the quenching;

subjecting the region to a heat treatment of heating the region at a temperature-raising rate of 0.4° C./second or more, holding the region in a temperature range of 300 to 590° C. for a time longer than zero second and not longer than 300 seconds and cooling the region at a cooling rate of 2000° C./minute or less; and subjecting the whole of the aluminum alloy extruded shape subjected to the heat treatment to an artificial aging treatment.

* * * * *